US010710150B2

(12) United States Patent
Tewes et al.

(10) Patent No.: US 10,710,150 B2
(45) Date of Patent: Jul. 14, 2020

(54) METHOD FOR PRODUCING A FOUNDRY CORE AND FOUNDRY CORE

(71) Applicant: Nemak, S.A.B. de C.V., Garcia (MX)

(72) Inventors: Sebastian Tewes, Aachen (DE); Franz-Josef Feikus, Bonn (DE)

(73) Assignee: Nemak, S.A.B. de C.V., Garcia, Nuevo Leon (MX)

( * ) Notice: Subject to any disclaimer, the term of this patent is extended or adjusted under 35 U.S.C. 154(b) by 80 days.

(21) Appl. No.: 15/568,080

(22) PCT Filed: Jul. 14, 2016

(86) PCT No.: PCT/IB2016/000999
§ 371 (c)(1),
(2) Date: Oct. 20, 2017

(87) PCT Pub. No.: WO2017/009708
PCT Pub. Date: Jan. 19, 2017

(65) Prior Publication Data

US 2019/0030592 A1 Jan. 31, 2019

(30) Foreign Application Priority Data

Jul. 14, 2015 (DE) ..... 10 2015 111 418

(51) Int. Cl.
*B22C 9/10* (2006.01)
*B22C 1/22* (2006.01)
*B22C 9/12* (2006.01)

(52) U.S. Cl.
CPC ..... *B22C 9/10* (2013.01); *B22C 1/2273* (2013.01); *B22C 9/103* (2013.01); *B22C 9/12* (2013.01)

(58) Field of Classification Search
CPC ..... B22C 1/22; B22C 1/2273; B22C 9/10; B22C 9/103
(Continued)

(56) References Cited

U.S. PATENT DOCUMENTS 6,286,582 B1 9/2001 Chartier et al.
6,720,028 B1 * 4/2004 Haaland ..... B22C 9/10 427/133
(Continued)

FOREIGN PATENT DOCUMENTS

CN 1735470 A 2/2006
CN 102873276 A 1/2013
(Continued)

OTHER PUBLICATIONS

Deng et al., "Metal Technology", Higher Education Press, Ed. 4, Mar. 2006, pp. 58-59.

*Primary Examiner* — Kevin P Kerns
(74) *Attorney, Agent, or Firm* — The Webb Law Firm

(57) ABSTRACT

Foundry cores, which consist of a mould material mixed from a binder and a mould sand, as well as optionally added additives, that are moulded in a complex way or are optimised with regard to their quality and which are provided for casting cast parts, can be produced by: a) moulding the foundry core by introducing the mould material into a foundry core mould; b) hardening the mould material; c) removing the foundry core from the foundry core mould; d) heating the foundry core to a deformation temperature; e) deforming the heated foundry core by applying a deformation force to the foundry core; and f) cooling the foundry core.

11 Claims, 3 Drawing Sheets

(58) Field of Classification Search
USPC ..... 164/16, 28, 369
See application file for complete search history.

(56) References Cited

U.S. PATENT DOCUMENTS

| | | | | |
|---|---|---|---|---|
| 8,627,877 | B2 * | 1/2014 | Gerlach | B22C 1/188 106/38.2 |
| 2006/0071364 | A1 | 4/2006 | Zenpo et al. | |
| 2013/0341822 | A1 | 12/2013 | Ellgass et al. | |

FOREIGN PATENT DOCUMENTS

| | | | |
|---|---|---|---|
| CN | 103317102 | A | 9/2013 |
| DE | 29717661 | U1 | 12/1998 |
| DE | 19742276 | A1 | 4/1999 |
| DE | 69914299 | T2 | 11/2004 |
| DE | 10341712 | B3 | 3/2005 |
| DE | 102008023336 | A1 | 11/2008 |
| DE | 112011101382 | T5 | 1/2013 |

* cited by examiner

METHOD FOR PRODUCING A FOUNDRY CORE AND FOUNDRY CORE

CROSS-REFERENCE TO RELATED APPLICATIONS

This application is the United States national phase of International Application No. PCT/IB2016/000999 filed Jul. 14, 2016, and claims priority to German Patent Application No. 10 2015 111 418.6 filed Jul. 14, 2015, the disclosures of which are hereby incorporated in their entirety by reference.

BACKGROUND OF THE INVENTION

Field of the Invention

The invention relates to a method for producing a foundry core for casting a cast part, as well as a foundry core as such. The foundry core in each case consists of a mould material which is mixed from a binder and a mould sand, as well as optionally added additives.

Description of the Related Art

Foundry cores of the type in question here are typically used for casting cast parts from a metal melt. They are referred to as "lost parts", since they are destroyed when the cast part is removed from the respective casting mould.

To produce a casting, metal melt is cast into the mould cavity enclosed by the respective casting mould. After or in the course of the hardening of the metal melt to form the casting, the casting mould is separated from the casting.

Usually, a casting mould comprises a plurality of foundry cores. These form cavities, channels and other recesses within the cast part. In the case of casting moulds which are composed as a so-called "core package", however, they also form the outer contour of the cast part.

The foundry cores are produced in moulding tools, so-called "core shooting machines", which comprise a core box divided into an upper and a lower core box half. The core box defines with its core box halves a mould cavity forming the foundry core to be produced. With the core box closed, a mould material is shot with pressure into this mould cavity. This process is called "core shooting". Subsequently, hardening of the foundry core takes place in the core box. Then, the core box is opened by movement of at least one of the core box halves, in order to remove the foundry core. In industrial mass production, normally a plurality of foundry cores are moulded in a core box at the same time, provided that their size allows this.

For producing foundry cores of the type in question, mould materials used are usually mixed from a basic mould material, for example an inorganic refractory mould sand, and a binder. In practice, inorganic or organic binders are used for this purpose. When using inorganic binders, hardening of the mould material takes place in the core box by the supply of heat and removal of moisture ("hot box method"), whereas when using organic binders, the cores are gassed with a reaction gas in the moulding tool, in order to bring about the hardening by means of a chemical reaction of the binder with the reaction gas ("cold box method").

Mould materials based both on inorganic and on organic binder systems are available on the market in various forms. At the same time, such mould materials, if need be, contain additives, in order to set their properties, particularly with regard to storability, flow behaviour etc.

With the known commercially available mould materials, it is possible to produce delicately formed foundry cores, i.e. foundry cores comprising small diameters, elongated thin sections and likewise finely formed branchings, the dimensional stability of which is sufficient for them to be transported from foundry core production to mould production, to hold them securely in the respective casting mould and also to absorb the stresses and strains occurring when casting the melt. However, the manner in which they are produced and the type of mould material used for producing them mean that the foundry cores to a large extent are brittle and correspondingly breakable.

The above described procedure, which is customary in industrial mass production, and the method of production based on the use of reusable moulds involve some restrictions with regard to the design of the foundry cores. Thus, mould release slopes must be provided in the mould cavity of the core box, so that the completed foundry core can be removed from the core box in an operationally reliable way without destroying it. When using a two-part core box customary in operational practice, the foundry cores cannot have any undercuts which would impede their removal from the mould. Should, however, foundry cores be produced with such undercuts, multi-part core box designs have to be used which require a great deal of technical effort and a correspondingly high investment outlay.

So-called "loose parts" are used in order to be able to form undercuts in known foundry core production. These are inserted into the core box, then enclosed with mould material and removed from the core box with the foundry core. As a result of the interlocking of loose part and mould material of the foundry core, due to the undercut to be formed in each case, the loose parts can only be separated from the foundry core after removal. In addition to the additional production steps associated with their use, such loose parts from a production point of view in terms of mass production have the disadvantage that a great many loose parts have to be in circulation, in order to guarantee a correct, synchronised production flow.

It should be added that even when using multi-part core boxes, freedom in the design of the foundry cores is limited. Hence, in every case it has to be ensured that the mould material can be shot into the core box cavity in such a way that it fills the mould cavity completely and is sufficiently compacted.

Therefore, with conventional foundry core production, certain core geometries, for example like an hour glass or like a wound helix, or comparably complexly shaped bodies, cannot be produced at all or only with extreme effort. Despite the, in principle, large amount of design freedom which core production based on the principles of the original form provides, the full design potential, which would be theoretically possible when casting with lost cores, can therefore not be exploited.

SUMMARY OF THE INVENTION

Against the background of the prior art explained above, the object arose to specify a method which enables foundry cores which are moulded in a complex way or which are optimised with regard to their quality to also be produced in a simple manner.

A correspondingly formed foundry core should also be created.

A foundry core achieving the object mentioned above according to the invention is correspondingly characterised by the fact that it is produced from a mould material which consists of a mixture of a binder and a mould sand, as well as optionally added additives, wherein the foundry core is brought into its final shape by means of a deformation brought about by external application of force. Such a foundry core can in particular be produced by applying the method according to the invention.

The method according to the invention for producing a foundry core, consisting of a mould material which is mixed from a binder and a mould sand, as well as optionally added additives, for casting a cast part comprises the following production steps:

a) moulding the foundry core by introducing the mould material into a foundry core mould;
b) hardening the mould material;
c) removing the foundry core from the foundry core mould;
d) heating the foundry core to a deformation temperature;
e) deforming the heated foundry core by applying a deformation force to the foundry core;
f) cooling the foundry core.

The invention is based on the surprising finding, which runs counter to the previous evaluations among experts in the field, that foundry cores produced in a conventional way can also still be deformed at a suitable temperature when they have already obtained their basic shape in a conventional core shooting machine. The deformation on the respective foundry core can be brought about by bending deformation, compressive deformation, tensile deformation, shear deformation, torsional deformation or by any other deformation brought about by application of external forces. By means of the deformation according to the invention, foundry cores produced from commercially available mould materials can subsequently obtain a shape which cannot be produced with conventional core shooting machines at all, only with limited quality or only with a particularly large amount of effort.

The invention in this way confers a high degree of design freedom and complexity in the development of cast parts. As a result, novel foundry core designs can be technically simply implemented. In particular, by subsequently deforming the cores according to the invention, undercuts can be produced without complex core boxes with loose parts having to be used.

The method according to the invention can also be used for subsequently optimising properties of the foundry cores obtained after core shooting. Therefore, foundry cores can be subsequently compacted in the manner according to the invention with the result that they have a higher dimensional stability and improved surface quality.

The deformation carried out according to the invention should take place at a slow deformation rate dependent on the brittleness which the respective mould material still exhibits during heating and taking into account the basic shape which the respective foundry core has after it has been removed from the core shooting machine. The respectively suitable maximum deformation rate can be experimentally determined in a simple manner. On the basis of practical tests, it could be shown here that even delicately formed foundry cores can be deformed in an operationally reliable manner according to the invention if the deformation rate is restricted to at most 2 mm/s, wherein, in practice, deformation rates of at least 0.01 mm/s should be the rule. Optimum deformation rates lie in the range from 0.1-1.0 mm/s, in particular 0.3-0.7 mm/s. By choosing these deformation rates, in particular foundry cores which have an elongated, delicate shape can be safely bent, twisted, pulled or compressed.

The deformation forces in the case of the deformation to be applied according to the invention acting externally on the respective foundry core can also be determined by simple experiments. Here, practical tests have shown that with deformation forces which with an 8 mm diameter of a sample which is circular in cross-section lie in the range from 5-100 N or correspond to specific strengths of the foundry cores of 0.2-0.6 N/mm$^2$, delicately formed foundry cores can also be subsequently deformed in the manner according to the invention. This in particular applies if the deformation takes place at deformation rates which lie in the ranges mentioned in the previous paragraph. Deformation forces of 20-80 N (corresponding to specific strengths of 0.1-0.4 N/mm$^2$), in particular 30-70 N (corresponding to specific strengths of 0.15-0.35 N/mm$^2$) have proved to be particularly effective here.

Basically, the invention can be applied with any type of foundry core produced from mould materials of the type in question here. This applies both for mould materials which contain an inorganic binder and for mould materials which are based on an organic binder. Practical tests have shown here that the invention can be utilised particularly well with foundry cores where an organic binder is used. It has been assumed that in particular such organic binders act like an adhesive as a result of heating the foundry cores according to the invention and in this way cause the grains of the mould material, from which the foundry cores are moulded, to stick together.

The respectively optimum deformation temperature, which the foundry cores are heated to before the deformation according to the invention takes place, can also be determined by simple experiments. Practical tests have shown here that deformation temperatures which lie in the range from 150-320° C., in particular 180-300° C., are practice-oriented. The upper limit of 300° C. proves to be particularly important in the case of mould materials with organic binders because otherwise there is the risk of premature deterioration of the binder.

The deformation temperature should be held in the above mentioned range during the subsequent deformation, wherein optimally a constant temperature level is maintained.

The heating-up rate when heating the foundry cores should be 1-15° C./s, in particular 4-8° C./s.

A heated tool, a convection oven or an infrared lamp can, for example, be used as the heat source for the heating according to the invention. General or localised heating of the foundry core by means of a concentrated hot air jet or the like is also conceivable.

The method according to the invention is also suitable, in the sense of a calibration, for optimising the shape of a foundry core. To that end, the foundry core is heated in the manner according to the invention after it has been removed from the core shooting machine and deformed by external application of force in such a way that it exactly corresponds to the respective specifications with respect to its geometry.

It is also conceivable, by means of a deformation according to the invention, to join two cores in a form-fit or force-fit manner which otherwise would have to be stuck together. For this purpose, a first foundry core which has a recess can be produced in the course of carrying out production steps a)-c). In addition, a second foundry core is provided which has a protrusion which is adapted to the shape of the recess of the first foundry core. The second foundry core can now be joined to the first foundry core such that the protrusion of the second foundry core engages with the recess of the first foundry core forming a joining zone.

Subsequently at least one of the foundry cores passes through the production steps d)-f) and in production step e) is deformed in such a way that in the area of the joining zone a tight form-fit connection is formed, by means of which the two foundry cores are joined together. In this way, two or more foundry cores can be joined together by connections which are designed, for example, like plug-and-socket or snap connections.

As an alternative to providing a foundry core with a protrusion adapted to the recess of the other foundry core, it is also possible to position a foundry core, formed without a distinctive protrusion, accordingly on the first foundry core provided with the recess and then press material of the second foundry core into the opening of the first foundry core. To that end, according to a further embodiment of the method according to the invention, by carrying out the production steps a)-c) a first foundry core is produced with a recess (A) and a second foundry core is provided which is then positioned on the first foundry core in a predetermined position, wherein after positioning at least the second foundry core passes through the production steps d)-f) and in production step e) by applying an external force is deformed in such a way that material of the second foundry core which is located in the area of the recess of the first foundry core enters the recess of the first foundry core and fills this recess, so that a tight form-fit connection is formed, by means of which the two foundry cores are joined together. In this way, a form-fit or force-fit connection is created between the foundry cores in the manner of a clinching process. Of course, marks, ledges or elevations or the like can be present on the foundry core whose material is pressed into the recess of the other respective foundry core, in order to make correct positioning of the foundry cores on one another easier. If the recess of the first foundry core is a through-hole, then it is also conceivable for the material of the second foundry core to be pressed through the recess to the extent that it spreads out on the side opposite the second foundry core and a firm connection between the foundry cores is created in the manner of a rivet connection.

BRIEF DESCRIPTION OF THE DRAWINGS

The invention is explained in more detail below with the aid of the figures illustrating exemplary embodiments.

DESCRIPTION OF THE INVENTION

The foundry cores G1, G3 illustrated in FIGS. 1 and 3*a*-4*b* represent, by way of example, elongated, delicate foundry cores which, for example, form delicately shaped oil supply channels or coolant channels when casting cylinder heads for internal combustion engines. Cylinder heads of this type nowadays are usually cast from aluminium casting materials.

Figure 1:
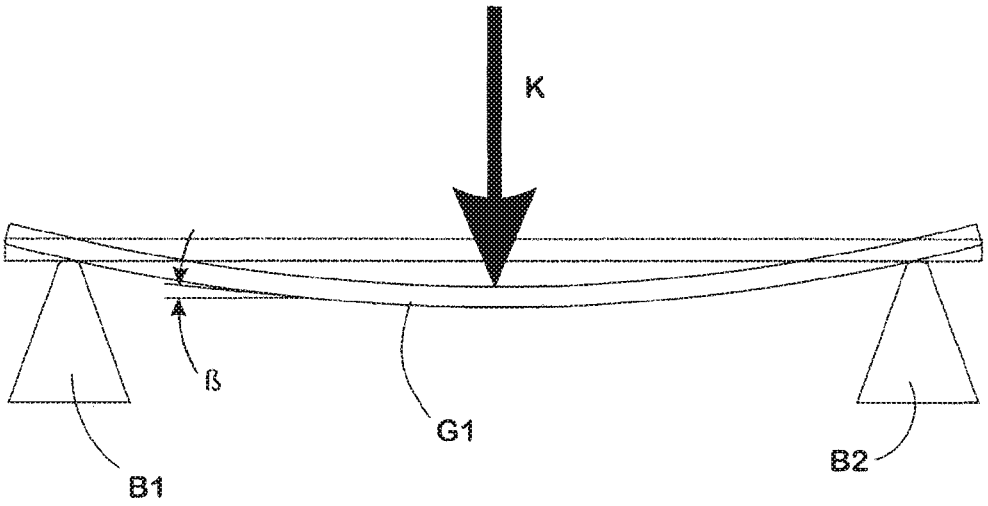
FIG. 1 schematically shows a rod-shaped foundry core before and after a deformation in a lateral view, wherein the shape before deformation is illustrated with dotted lines and the shape after deformation is illustrated with continuous lines.
Figure 2:
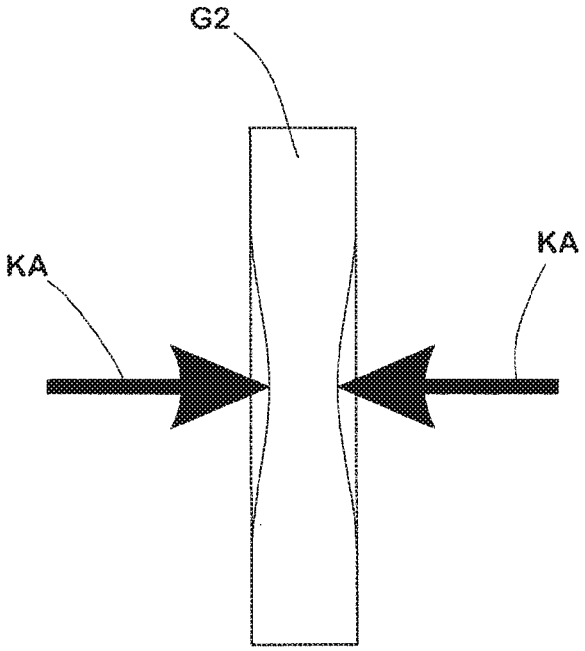
FIG. 2 schematically shows a rectangular-shaped foundry core before and after a deformation in a lateral view, wherein the shape before deformation is illustrated with dotted lines and the shape after deformation is illustrated with continuous lines.
Figure 3B:
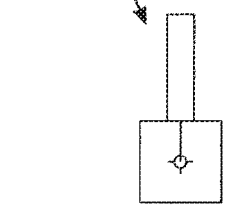
FIG. 3*b* schematically shows the foundry core according to FIG. 3*a* in an end view.
Figure 3A:
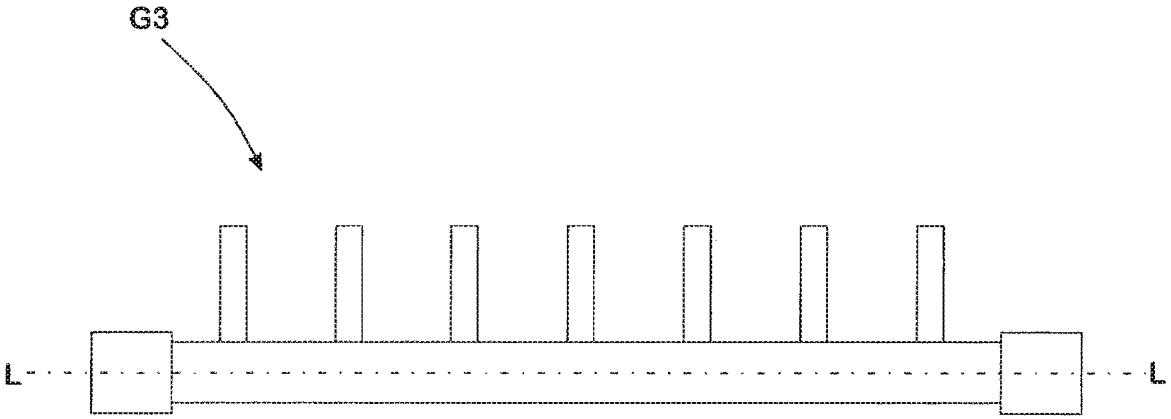
FIG. 3*a* schematically shows another rod-shaped foundry core with a plurality of branchings formed on to it before a deformation in a lateral view.
Figure 4B:
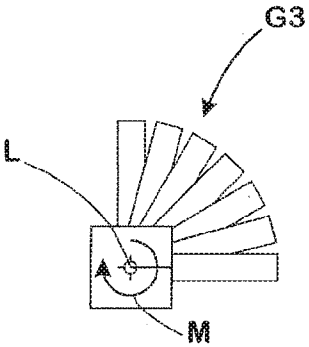
FIG. 4*b* schematically shows the foundry core according to FIG. 4*a* in an end view.
Figure 4A:
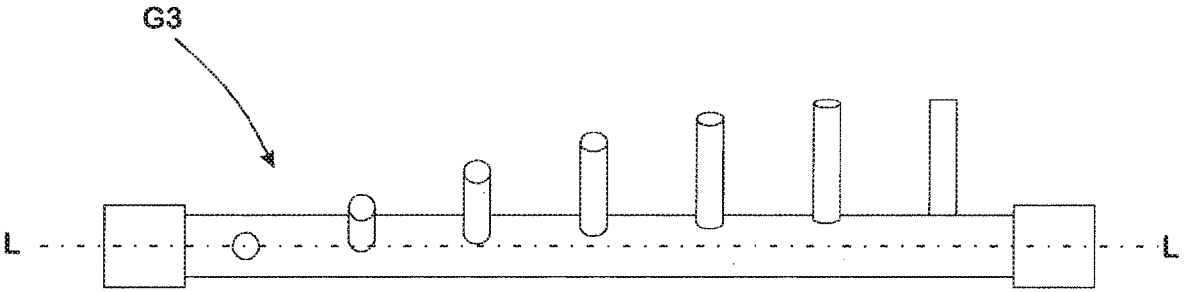
FIG. 4*a* schematically shows the foundry core according to FIG. 3 after a deformation in a lateral view.
Figure 5B:
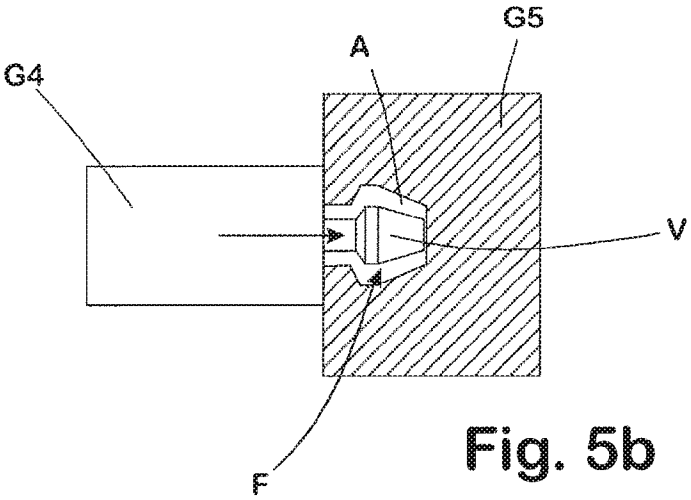
FIGS. 5*a*-5*d* schematically show two foundry cores in the different production steps which are carried out when joining these foundry cores, in each case in a lateral, partly cutaway view.
Figure 5D:
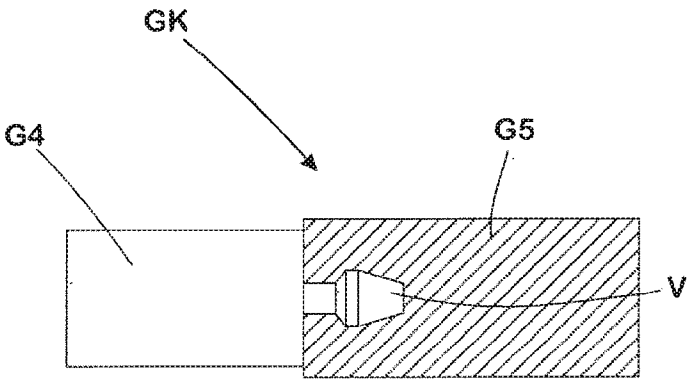
Figure 5A:
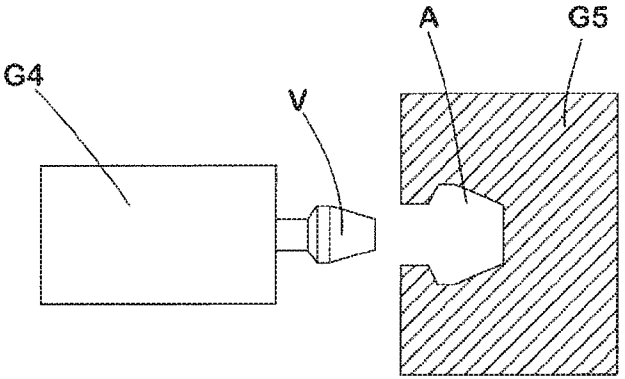
Figure 5C:
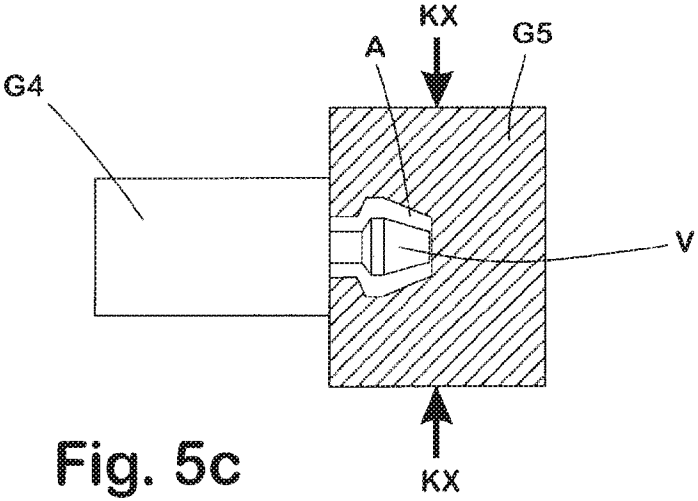

The cylindrical foundry core G2 illustrated in FIG. 2 is provided to form a cavity for an internal combustion engine, for example when an engine block is being cast.

The foundry cores G4, G5 illustrated in FIGS. 5*a*-5*d* represent those foundry cores which are joined together to form a foundry core combination GK, in order to mould complex forms of cavities or channels in a cast part cast from any metal melt.

The foundry cores G1-G5 have each been produced in the so-called "PU cold box process".

The binder used in the PU cold box process comprises two components, namely phenol formaldehyde resin as the first component and isocyanate as the second component. A polyaddition of these two components to form polyurethane is brought about by gassing with a tertiary amine.

To produce the mould material, the foundry sand is mixed with the phenol formaldehyde resin and the isocyanate for two to five minutes, in particular for three minutes, in a suitable mixer, e.g. an oscillating mixer or paddle mixer. The added amount of both components of the binder can vary depending on the application and the foundry sand. They are typically between 0.4 and 1.2% for each part in relation to the added amount of mould material. A ratio of 0.7% for each part has proved to be particularly favourable.

When "parts" are mentioned as the metering measure here, then this is taken to mean that the amount of the constituent, measured in parts in each case, is measured by means of a standard measure which is the same for all constituents and the "parts", provided according to the invention for the individual constituents in each case, constitute the respective multiple of this standard measure.

The fully mixed mould material was formed in a conventional core shooting machine into the foundry cores G1-G5. The mould material was shot into a core box at a shooting pressure of approximately 2-6 bar, in particular 3 bar, and compacted there. Then, the foundry cores G1-G5 were gassed in the core box with the gaseous catalyst, the tertiary amine, in order to bring about the hardening of the cores. The hardening process was carried out until the foundry cores G1-G5 had obtained a strength of 150-300 $N/cm^2$ typical for PU cold box cores. A value of 220 $N/cm^2$, regarded as optimum, was deemed to be the target value here.

The rod-shaped foundry core G1 produced in this way has, for example, a circular cross-section of 10 mm and a length of 200 mm. The foundry core G3 was correspondingly dimensioned.

The foundry cores G1-G3 obtained in each case were now heated through in a convection oven at a heating-up rate of 5° C./s to a preheating temperature of 220° C.

The foundry cores G1-G3 heated in this way were subsequently deformed.

To that end, the foundry core G1 was positioned with its end sections on two supports B1, B2 arranged spaced apart from one another with rounded rests. Subsequently, force was applied by a force K acting in the direction of gravity. This external force K was applied by means of a punch not illustrated in detail here which is aligned centrally in relation to the longitudinal extension of the foundry core G1 and is rounded on its abutting face coming into contact with the foundry core G1, in order to prevent compressive load peaks on the foundry core G1 during deformation. The load via the force K occurred in a quasi-static way at a deformation rate of 0.5 mm/s. The force K introduced was 40 N.

The deformation process was completed after the target deformation angle β of approximately 20-30 degrees was obtained. During the deformation process, the foundry core G1 was constantly held in a range around the deformation temperature of 220° C.±30° C.

The foundry core G1 plastically deformed in this way was cooled in quiescent air down to room temperature. Subsequently, it was able to be used in the casting process like a conventionally formed foundry core.

The foundry core G2, like the foundry core G1, was heated in the above described way and subsequently deformed by means of a punch-like tool (likewise not shown here) by external application of force KA such that it obtained the shape of an hour glass. In the process, the mould material was compacted, which had a positive effect on its dimensional stability and its surface quality. At the same time, the foundry core was calibrated, so that its shape corresponded to the geometrical specifications in an optimum way.

The foundry core G3 was also heated to the deformation temperature in the way described above for the foundry core G1. Subsequently, the heated foundry core G3 was clamped with its one end into a holder and on its other end a torque M acting about its longitudinal axis L was applied as an external force. In this way, the foundry core G3 could be twisted about its longitudinal axis L by an angle of 90°.

The two foundry cores G4, G5 were also produced in the way described above for the foundry cores G1-G3. The foundry core G4 had a protrusion V on its one front end, whereas a recess A was formed into the assigned front end of the foundry core G5, the shape of which with a certain excess represents a negative of the shape of the protrusion V of the foundry core G4.

Correspondingly, the foundry core G4 could be inserted with its protrusion V into the recess A of the foundry core G5, so that the foundry cores G4, G5 were joined in the area of a joining zone F defined by the recess A.

Subsequently, at least the foundry core G5 was brought to a deformation temperature in the range from 180-300° C. by concentrated heating for example in a hot air jet. Then, the foundry core G5 had an external force KX applied to it by means of a suitable tool (not shown here) such that the material of the foundry core G5 surrounding the recess A was compressed. The material of the foundry core G5 surrounding the recess A was in this way pressed against the protrusion V until the protrusion V was tightly enclosed by the material of the foundry core G5 and a tight form-fit connection was formed, by means of which the foundry core G4 was permanently fixed in every degree of freedom in relation to the foundry core G5 and the foundry core combination GK was formed.

REFERENCE SYMBOLS

β deformation angle
A recess of the foundry core G5
B1, B2 supports
F joining zone
G1-G5 foundry cores
GK foundry core combination
K, KA, KX external forces
L longitudinal axis of the foundry core G3
M torque
V protrusion of the foundry core G4

The invention claimed is:

1. A method for producing a foundry core for casting a cast part, wherein the foundry core consists of a mould material comprising a binder, a mould sand, and optionally added additives, comprising the following production steps:

a) moulding the foundry core by introducing the mould material into a foundry core mould;
b) hardening the mould material;
c) removing the foundry core from the foundry core mould;
d) heating the foundry core to a deformation temperature;
e) plastically deforming the heated foundry core by applying a deformation force to the foundry core; and
f) subsequently cooling the foundry core, wherein the plastic deformation of the heated foundry core is conducted at the deformation temperature and changes a shape of the foundry core and the foundry core retains the change in shape created by the plastic deformation after the subsequent cooling.

2. The method according to claim 1, wherein the deformation force brings about a bending deformation, compressive deformation, tensile deformation, shear deformation or torsional deformation of the foundry core.

3. The method according to claim 1, wherein the deformation is carried out at a deformation rate of at most 2 mm/s.

4. The method according to claim 1, wherein the deformation force is 5-100 N.

5. The method according to claim 1, wherein the foundry core is fully hardened in production step b).

6. The method according to claim 1, wherein the binder of the mould material is an organic binder.

7. The method according to claim 1, wherein the deformation temperature is 180-300° C.

8. The method according to claim 1, wherein the heating-up rate when heating the foundry core to the deformation temperature is 1-15° C./s.

9. The method according to claim 1, wherein by carrying out the production steps a)-c) a first foundry core is produced with a recess, in that a second foundry core is provided which has a protrusion which is adapted to the shape of the recess of the first foundry core, in that the second foundry core is joined to the first foundry core such that the protrusion of the second foundry core engages with the recess of the first foundry core forming a joining zone, and in that subsequently at least one of the foundry cores passes through the production steps d)-f) and in production step e) is deformed in such a way that in the area of the joining zone a tight form-fit connection is formed, by means of which the two foundry cores are joined together.

10. The method according to claim 1, wherein by carrying out the production steps a)-c) a first foundry core is produced with a recess, in that a second foundry core is provided and this foundry core is positioned on the first foundry core in a predetermined position, in that at least the second foundry core passes through production steps d)-f) and in production step e) by applying an external force is deformed in such a way that material of the second foundry core which is located in the area of the recess of the first foundry core enters the recess of the first foundry core and fills this recess, so that a tight form-fit connection is formed, by means of which the two foundry cores are joined together.

11. The method according to claim 1, wherein the deformation temperature is 150-320° C.

* * * * *